US008898826B2

(12) United States Patent
Kobzan

(10) Patent No.: US 8,898,826 B2
(45) Date of Patent: Dec. 2, 2014

(54) BATHTUB BACK SUPPORT SYSTEMS

(75) Inventor: Heather Kobzan, Pickering (CA)

(73) Assignee: Heather Kobzan, Pickering, Ontario (CA)

( * ) Notice: Subject to any disclaimer, the term of this patent is extended or adjusted under 35 U.S.C. 154(b) by 1084 days.

(21) Appl. No.: 12/905,082

(22) Filed: Oct. 15, 2010

(65) Prior Publication Data

US 2011/0131721 A1 Jun. 9, 2011

Related U.S. Application Data

(60) Provisional application No. 61/267,479, filed on Dec. 8, 2009.

(51) Int. Cl.
*A47K 3/024* (2006.01)
*A47K 3/12* (2006.01)

(52) U.S. Cl.
CPC ..... *A47K 3/125* (2013.01)
USPC ..... 4/575.1

(58) Field of Classification Search
CPC ..... A47K 3/12; A47K 3/122; A47K 3/124
USPC ..... 4/575.1, 578, 1, 579
See application file for complete search history.

(56) References Cited

U.S. PATENT DOCUMENTS

| | | | | |
|---|---|---|---|---|
| 1,676,354 | A * | 7/1928 | Sachsse | 4/575.1 |
| 1,759,348 | A | 5/1930 | Fishman | |
| 2,483,077 | A * | 9/1949 | Walsh | 4/561.1 |
| 3,583,001 | A | 6/1971 | Steinhoff | |
| 4,725,094 | A * | 2/1988 | Greer | 297/229 |
| 4,877,288 | A * | 10/1989 | Lee | 297/229 |
| 5,439,405 | A * | 8/1995 | Storey et al. | 441/127 |
| 5,535,458 | A * | 7/1996 | Siverly | 4/579 |
| 6,014,779 | A * | 1/2000 | Lindholm | 4/583 |
| 6,038,713 | A | 3/2000 | Grosse | |
| 6,086,152 | A * | 7/2000 | Zeller | 297/284.5 |
| 6,493,891 | B1 * | 12/2002 | Livingston | 5/636 |
| 6,691,337 | B1 | 2/2004 | Banks | |
| 2006/0272084 | A1 | 12/2006 | Bauman et al. | |

* cited by examiner

*Primary Examiner* — Huyen Le

(57) ABSTRACT

A back rest device for a bathtub comprising a rest member having a front surface and a back surface, at least one suction cup, a cover with pockets, and at least one insertable pillow. The rest member is placed against a bathtub back and on a cushioned bathmat that suctions to the floor of the bathtub. The suction cups are attached to the back surface of the rest member to facilitate the attachment of the rest member to the bathtub back. The cover with pockets is attached to the front surface of the rest member and the insertable pillow is placed inside the pockets to create additional comfort.

17 Claims, 5 Drawing Sheets

BATHTUB BACK SUPPORT SYSTEMS

CROSS-REFERENCE TO RELATED APPLICATION

The present application is related to and claims priority from prior provisional application Ser. No. 61/267,479, filed Dec. 8, 2009 which application is incorporated herein by reference.

BACKGROUND OF THE INVENTION

1. Field of the Invention

The present invention relates generally to the field of bathtub devices and more specifically relates to a back rest device for a bathtub.

2. Description of the Related Art

Since Roman times people have benefitted from bathing not only for cleanliness sake but also to relieve back and muscle pain. The luxurious bathing facilities of Roman times consisted of marble baths and ornate public bathing facilities. Modern baths are not as luxurious as their Roman counterparts they usually are specifically functional and simplistic.

A bath should promote relaxation of strained muscles and back pain which is not the case with many of the modern baths found in homes or hotels resulting in just the opposite effect. The majority of baths have a straight back forcing the bather to sit in an upright and uncomfortable position. This may cause muscle strain and a stiff neck. This is an ongoing problem which requires a solution that at present does not exist.

Therefore a need exists for a device which makes bathing more therapeutic and comfortable giving the bather a feeling of well being on leaving the bathtub. A need exists for a device which is placed over the straight bathtub back resulting in a more comfortable seating and back position and which additionally gives a soft and cozy sensation to the bather.

Various attempts have been made to solve the above-mentioned problems, such as those found in U.S. Pat. Nos. 2006/0272084, 6,691,337, 1,759,348, 5,535,458, 3,583,001, and 6,038,713. This prior art is representative of bathtub devices. None of the above inventions and patents, taken either singly or in combination, is seen to describe the invention as claimed.

Ideally, a back rest device for a bathtub should improve the posture of the seated bather resulting in support of the spine and neck. The back rest device should be easy to install, affordable, should operate reliably and be manufactured at a modest expense. Thus, a need exists for a reliable back rest device to put a bather in a comfortable and relaxing position and to avoid the above-mentioned problems.

BRIEF SUMMARY OF THE INVENTION

In view of the foregoing disadvantages inherent in the known bathtub devices art, the present invention provides a novel bathtub back support system. The general purpose of the present invention, which will be described subsequently in greater detail, is to provide a device which makes bathing more comfortable by reducing strain on back and neck.

A back rest device for a bathtub is disclosed herein comprising a rest member, at least one suction cup, a cover with at least three pockets, and at least one insertable pillow. The rest member has a front surface and a back surface which comprise latitudinal slats. The slats are spaced apart from each other and may be made of waterproof plastic material.

The rest member is placed against a bathtub back and secured in place by leaning it up against a cushioned bathmat that suctions to the floor of the bathtub. Additionally, the rest member may comprise at least one suction cup which is attached to the back surface of the rest member to facilitate the attachment of the rest member to the bathtub back.

A terrycloth cover with at least three pockets is attachable to the front surface of the rest member by inserting and draping the terrycloth cover with pockets between the two upper slats of the rest member. Additionally, the terrycloth cover comprises at least one attacher comprising a cord situated at an upper end of the terrycloth cover with pockets. The cord can be looped and tied to the upper slat to provide a secure positioning.

The back rest device further includes at least one insertable pillow comprising a sponge which is placed inside the pockets to create additional comfort.

The present invention holds significant improvements and serves as a bathtub back support system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, bathtub back support systems, constructed and operative according to the teachings of the present invention.

The various embodiments of the present invention will hereinafter be described in conjunction with the appended drawings, wherein like designations denote like elements.

DETAILED DESCRIPTION

Figure 1:
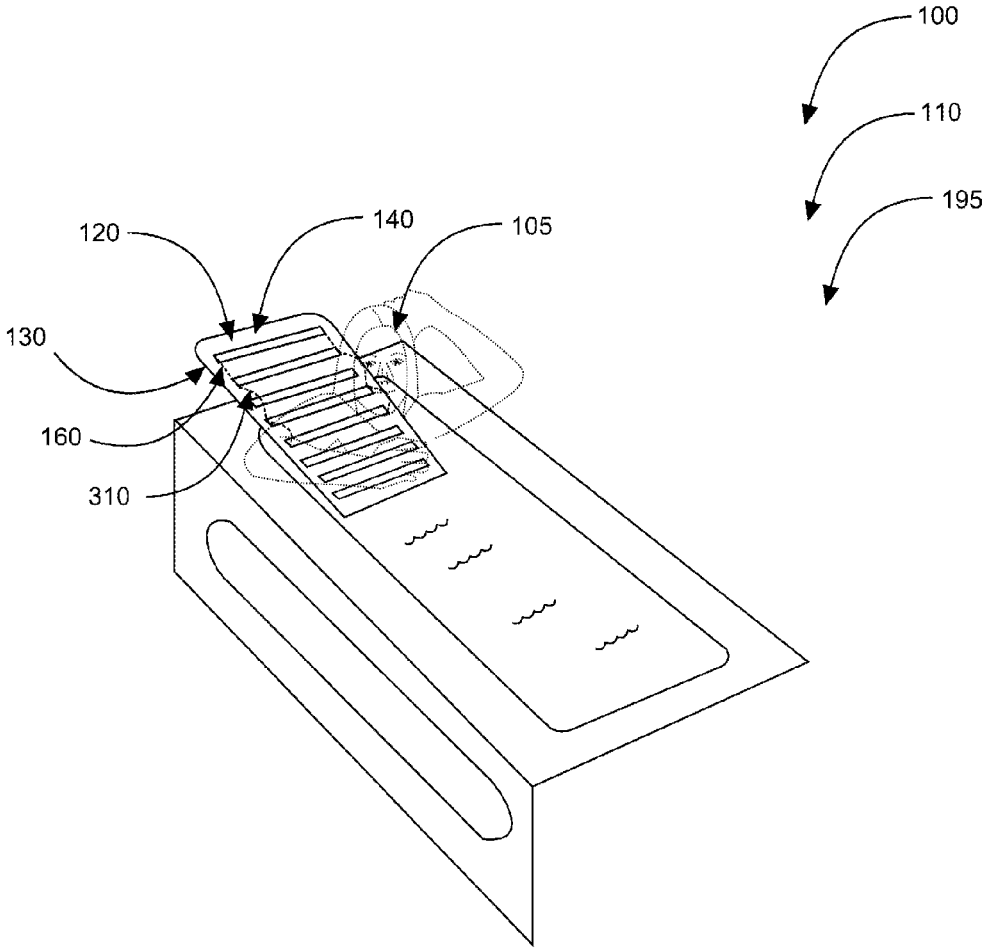
FIG. 1 shows a perspective view illustrating a back rest device for a bathtub in use according to an embodiment of the present invention.

As discussed above, embodiments of the present invention relate to a back rest device for a bathtub and more particularly to a bathtub back support system as used to make bathing more comfortable by reducing strain on back and neck. Referring to the drawings by numerals of reference there is shown in FIG. 1, a perspective view illustrating a back rest device for a bathtub 110 in an in-use condition 195 according to an embodiment of the present invention.

Back rest device for a bathtub 110 of the present invention preferably comprises a rest member 140 having a front surface 120 and a back surface 130, at least one suction cup 150, a cover with pockets 160, and at least one insertable pillow 170. Rest member 140 is placed against a bathtub back 180 and at least one suction cup 150 which is attached to back surface 130 of rest member 140 is used to facilitate the attachment of rest member 140 to bathtub back 180. Cover with pockets 160 is preferably attached to front surface 120 of rest member 140 and insertable pillow 170 is placed inside pockets 310 to create additional comfort and support.

Back rest device for a bathtub 110 may be placed over a straight bathtub back 180 in an angled position to afford the utmost comfort and support of the user's back. User 105 supported by back rest device for a bathtub 110 will experience comfort, support, and relaxation of strained muscles and relief of back pain while bathing. User 105 therefore is not forced to sit in an upright and uncomfortable position. Added comfort is afforded by cover with pockets 160 in which insertable pillow 170 is placed. Insertable pillow 170 which preferably comprises a sponge will give user 105 a soft cushioned surface to lean against thereby adding to the positive benefits of the back rest device for a bathtub 110.

Figure 2:
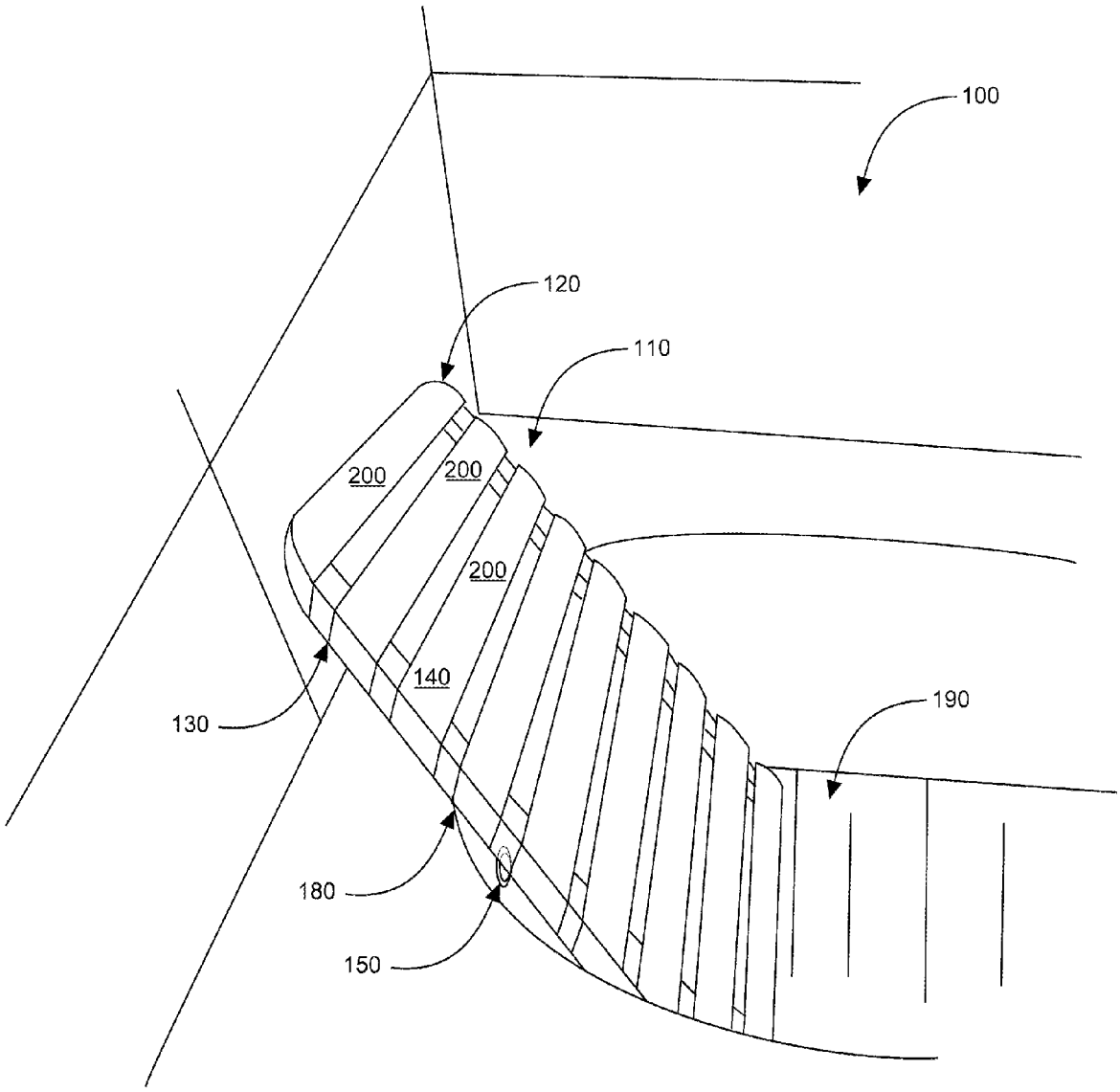
FIG. 2 is a perspective view illustrating the back rest device for a bathtub according to an embodiment of the present invention of FIG. 1.

Referring now to FIG. 2 a perspective view illustrating the back rest device for a bathtub 110 according to an embodiment of the present invention of FIG. 1.

Back rest device for a bathtub 110 preferably comprises rest member 140 having front surface 120 and back surface 130 comprising evenly spaced latitudinal slats 200. Rest member 140 may preferably be at a suitable height and width to fit in various sized bathtubs. Rest member 140 is of rectangular shape and preferably comprises rounded corners and edges to substantially prevent injury. Latitudinal slats 200 are spaced apart so as to make back rest device for a bathtub 110 lightweight and easy to transport. However, rest member 140 may comprise a solid board without latitudinal slats 200. Rest member 140 is preferably made of plastic. However, rest member 140 may comprise virtually any durable, lightweight, and waterproof material.

To prevent rest member 140 from slipping, rest member 140 is placed against a bathtub back 180 and secured in place by leaning rest member 140 up against a cushioned bathmat 190 that suctions to the floor of the bathtub. Additionally, at least one suction cup 150 is attached to back surface 130 of rest member 140. Suction cup 150 adheres to bathtub and thereby creates stability and a connection between rest member 140 and bathtub back 180. Rest member 140 preferably comprises two suction cups 150 positioned at the back of rest member 140.

Rest member 140 preferably protrudes above the edge of bathtub to a height sufficiently high to suit user 105 and provide an optimal, spacious, and comfortable area. Rest member 140 thereby provides support for the entire back and head of user. Rest member 140 is placed into bathtub at an angle which may vary according to user's 105 preferences. The point of intersection of rest member 140 and bathtub is preferably the upper edge of bathtub back 180.

Figure 3:
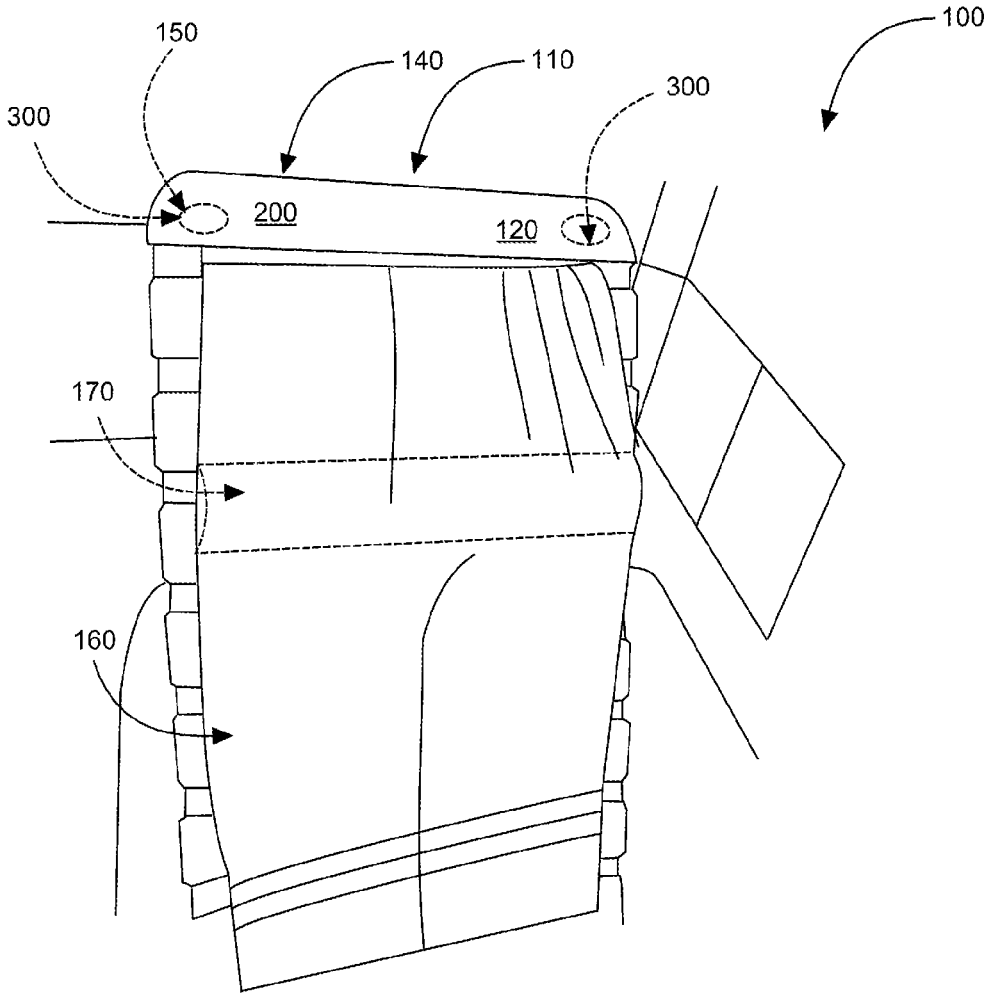
FIG. 3 is a perspective view illustrating the back rest device for a bathtub according to an embodiment of the present invention of FIG. 1 and FIG. 2.

Referring now to FIG. 3, a perspective view illustrating the back rest device for a bathtub 110 according to an embodiment of the present invention of FIGS. 1 and 2.

Back rest device for a bathtub 110 comprises a cover with pockets 160 which preferably are of a suitable size to insert insertable pillow 170. Cover with pockets 160 thereby covers a large portion of front surface 120 of rest member 140. Cover with pockets 160 preferably comprises terrycloth. However, cover with pockets 160 may comprise virtually any other suitable fabric, such as cotton or polyester. Cover with pockets 160 may be attached to front surface 120 of rest member 140 by inserting and draping cover with pockets 160 between the two upper latitudinal slats 200 of rest member 140. Furthermore, cover with pockets 160 may comprise at least one attacher 300 in the form of a cord situated at an upper end of cover with pockets 160 which can be looped and tied to upper latitudinal slat 200 of rest member 140. However, attacher 300 may comprise various attaching means, such as press studs, hooks or Velcro fasteners.

Figure 4:
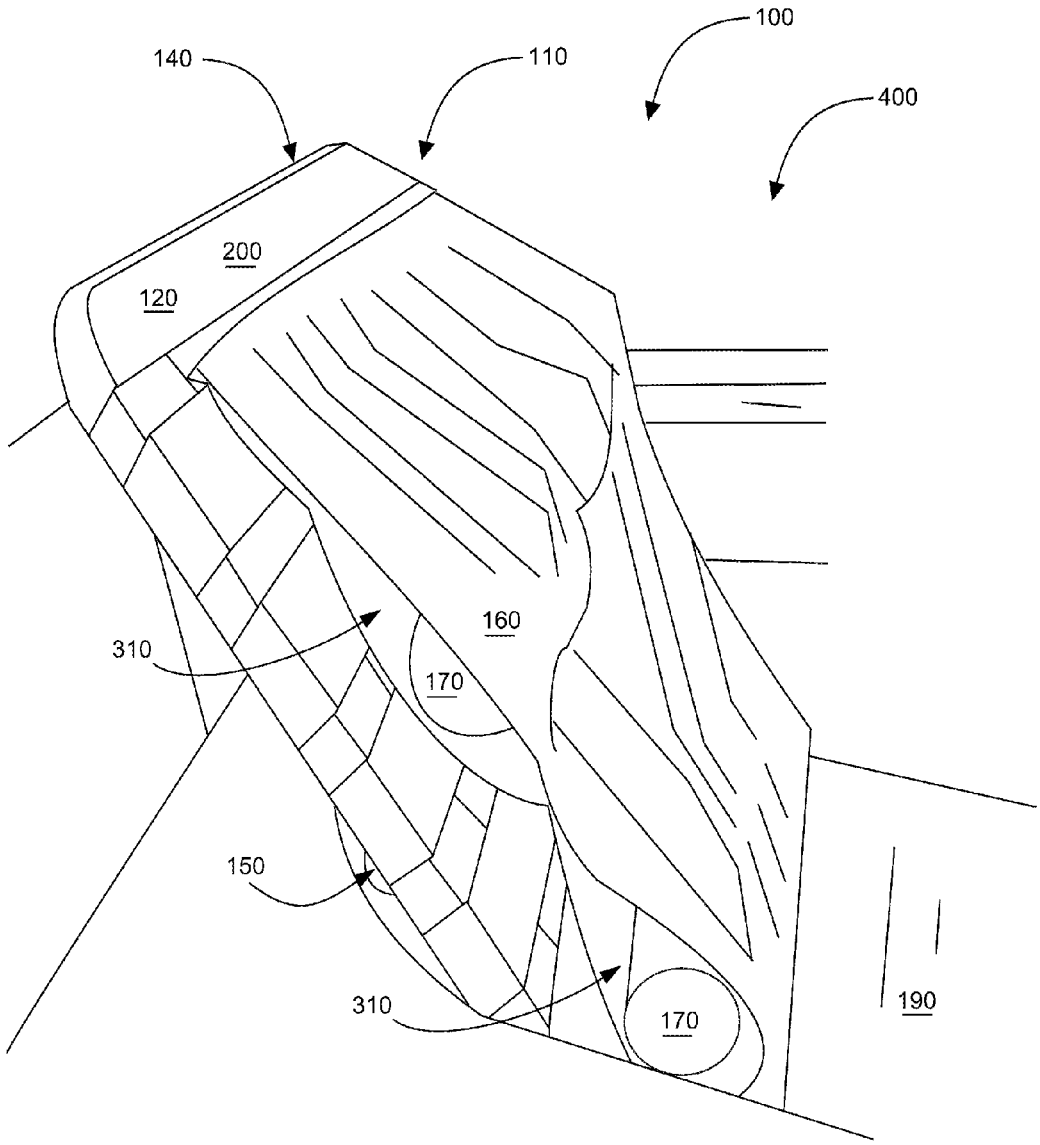
FIG. 4 is a perspective view illustrating the back rest device for a bathtub according to an embodiment of the present invention of FIGS. 1-3.

Referring now to FIG. 4, a perspective view illustrating the back rest device for a bathtub 110 according to an embodiment of the present invention of FIGS. 1-3.

Cover with pockets 160 preferably comprises three pockets 310. Three pockets 310 run the entire width of cover with pockets 160 and are adjacent to each other. Pockets 310 are accessible from either side of each pocket 310 and are sufficiently sized for each pocket 310 to accommodate an insertable pillow 170. Insertable pillow 170 preferably comprises a sponge which fits snugly into each pocket 310. However, insertable pillow 170 may comprise any suitable comfortable and soft material, such as polyester. In certain embodiments insertable pillow 170 may be air-inflatable.

Once insertable pillows 170 are inserted and cover with pockets 160 is attached to rest member 140, user 105 will have a comfortable, soft backrest device for a bathtub 110 which will improve the posture of user 105 resulting because of the support of the spine and neck. The soft and cushioned rest member 140 not only provides support for a user's 105 back but affords user 105 a pleasant and therapeutic bathing experience.

Bathtub back support system 100 may be sold as a kit 400 comprising the following parts: at least one rest member 140 having a front surface 120 and a back surface 130; at least one suction cup 150 or other attaching means; at least one cover with pockets 160; at least one insertable pillow 170; and at least one set of user instructions. Bathtub back support system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

Figure 5:
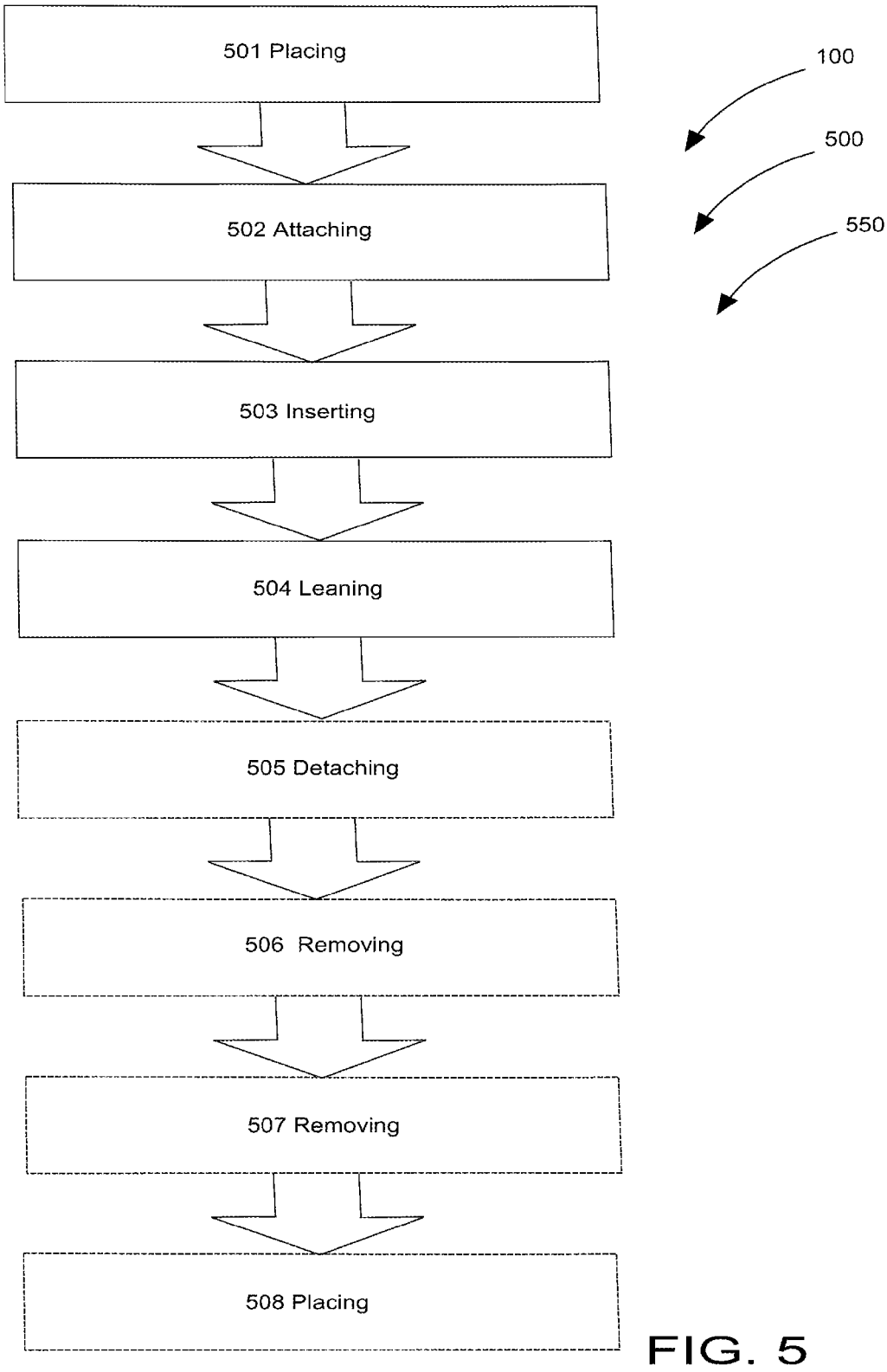
FIG. 5 is a flowchart illustrating a method of use according to an embodiment of the present invention of FIGS. 1-4.

Referring now to FIG. 5, a flowchart 550 illustrating a method of use 500 according to an embodiment of the present invention of FIGS. 1-4.

In accordance with the embodiments of the present invention a preferred method of use 500 is disclosed herein comprising the following steps: step one 501 placing a back rest device for a bathtub 110 against a bathtub back 180; step two 502 attaching at least one suction cup 150 situated on a back surface 130 of back rest device for a bathtub 110 to bathtub back 180; step three 503 inserting at least one insertable pillow 170 into a cover with pockets 160 which is attached to a front surface 120 of back rest device for a bathtub 110; step four 504 leaning against a back rest device for a bathtub 110 while user 105 is bathing; step five 505 detaching at least one suction cup 150 situated on back surface 130 of back rest device for a bathtub 110 from bathtub back 180; step six 506 removing back rest device for a bathtub 110 from bathtub back 180; step seven 507 removing at least one insertable pillow 170 from cover with pockets 160 which is attached to a front surface 120 of back rest device for a bathtub 110; step eight 508 placing back rest device for a bathtub 110 against bathtub back 180 and securing it in place by leaning back rest device for a bathtub 110 up against a cushioned bathmat 190 that suctions to the floor of bathtub. The present invention may be removed and dried for the next in-use period.

It should be noted that steps 505-508 are optional steps and may not be implemented in all cases. Optional steps of method of use 500 are illustrated using dotted lines in FIG. 5 so as to distinguish them from the other steps of method of use 500.

It should be noted that the steps described in the method of use 500 can be carried out in many different orders according to user preference. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A back rest device for a bathtub comprising:
- a rest member having a front surface and a back surface;
- at least one suction cup;
- a cover with pockets; and
- at least one insertable pillow;
- wherein said rest member is placed against a bathtub back;
- wherein said at least one suction cup is attached to said back surface of said rest member to facilitate the attachment of said rest member to said bathtub back;
- wherein said cover with pockets is attached to said front surface of said rest member by inserting and draping said cover with pockets between two upper slats of said rest member; and
- wherein said insertable pillow is placed inside said pockets to create additional comfort.

2. The back rest device for a bathtub of claim 1 wherein said rest member has a front surface and a back surface comprising plastic.

3. The back rest device for a bathtub of claim 1 wherein said rest member having a front surface and a back surface comprises waterproof material.

4. The back rest device for a bathtub of claim 1 wherein said rest member has a front surface and a back surface which comprise latitudinal slats.

5. The back rest device for a bathtub of claim 4 wherein said latitudinal slats are space oriented apart from each other.

6. The back rest device for a bathtub of claim 1 wherein said cover with pockets comprises terrycloth.

7. The back rest device for a bathtub of claim 1 wherein said cover with pockets comprises at least three pockets.

8. The back rest device for a bathtub of claim 1 wherein said cover with pockets comprises non-absorptive material.

9. The back rest device for a bathtub of claim 1 wherein said cover with pockets is attached to said front surface of said rest member via at least one attacher situated at an upper end of said cover with pockets.

10. The back rest device for a bathtub of claim 9 wherein said at least one attacher comprises a cord which can be looped and tied to an upper slat.

11. The back rest device for a bathtub of claim 1 wherein said insertable pillow comprises a sponge.

12. The back rest device for a bathtub of claim 1 wherein said rest member is placed against said bathtub back and secured in place by leaning up against a cushioned bathmat that suctions to the floor of said bathtub.

13. A back rest device for a bathtub comprising:
- a rest member having a front surface and a back surface comprising latitudinal slats space oriented apart from each other comprising waterproof plastic material;
- at least one suction cup which is attached to said back surface of said rest member to facilitate attachment of said rest member to a bathtub back;
- a terrycloth cover with at least three pockets which is attached to said front surface of said rest member by inserting and draping said terrycloth cover with pockets between two upper slats of said rest member and via at least one attacher comprising a cord situated at an upper end of said terrycloth cover with pockets which can be looped and tied to said upper slats; and
- at least one insertable pillow comprising a sponge which is removably insertable inside said pockets to create additional comfort for a user-bather;
- wherein said rest member is placed against said bathtub back and secured in place by leaning up against a cushioned bathmat that suctions to a floor of said bathtub.

14. The back rest device for a bathtub of claim 13 wherein said back rest device for a bathtub further comprises a kit including said at least one rest member having a front surface and a back surface, said at least one suction cup, said at least one cover with pockets, said at least one insertable pillow and a user instruction manual.

15. A method of use for a backrest device for a bathtub comprising the steps of:
- placing a back rest device for a bathtub against a bathtub back;
- attaching at least one suction cup situated on a back surface of said back rest device for a bathtub to said bathtub back;
- attaching a cover with pockets to a front surface of said back rest device by inserting and draping said cover with pockets between two upper slats of said back rest device;
- inserting at least one insertable pillow into said cover with pockets;
- leaning against said back rest device for a bathtub while a user is bathing.

16. The method of claim 15 further comprising the steps of:
- detaching at least one suction cup situated on said back surface of said back rest device for a bathtub from said bathtub back;
- removing said back rest device for a bathtub from said bathtub back;
- removing said at least one insertable pillow from said cover with pockets which is attached to a front surface of said back rest device for a bathtub.

17. The method of claim 16 further comprising the steps of:
- placing said back rest device for a bathtub against said bathtub back and securing it in place by leaning said back rest device for a bathtub up against a cushioned bathmat that suctions to the floor of said bathtub.

* * * * *